United States Patent [19]

Achelpohl et al.

[11] 4,279,686

[45] Jul. 21, 1981

[54] APPARATUS FOR APPLYING WEB SECTIONS TO A FLAT-LYING WORKPIECE

[75] Inventors: Fritz Achelpohl, Lengerich; Werner Decker, Ladbergen, both of Fed. Rep. of Germany

[73] Assignee: Windmöller & Hölscher, Lengerich, Fed. Rep. of Germany

[21] Appl. No.: 44,757

[22] Filed: Jun. 1, 1979

[30] Foreign Application Priority Data

Jun. 5, 1978 [DE] Fed. Rep. of Germany ..... 2824596

[51] Int. Cl.[3] ..... B35B 35/00

[52] U.S. Cl. ..... 156/517; 156/521; 156/556

[58] Field of Search ..... 156/521, 519, 517, 552, 156/556, 264, 265; 269/21, 56, 63

[56] References Cited

U.S. PATENT DOCUMENTS

| | | | |
|---|---|---|---|
| 2,279,724 | 4/1942 | von Hofe | 156/521 |
| 2,684,775 | 7/1954 | von Hofe | 156/521 |

FOREIGN PATENT DOCUMENTS 1924109 5/1969 Fed. Rep. of Germany .

*Primary Examiner*—Caleb Weston
*Attorney, Agent, or Firm*—Fleit & Jacobson

[57] ABSTRACT

A web of material is intermittently fed by feed rollers between and beyond pairs of clamping jaws comprising separated segments defining a gap receiving a reciprocatable severing knife. Beyond the clamping jaws, suction means hold the leading web end and, after said end has been severed, can be swung onto a support for a workpiece to which the severed web section is to be applied.

14 Claims, 5 Drawing Figures

Fig. 4
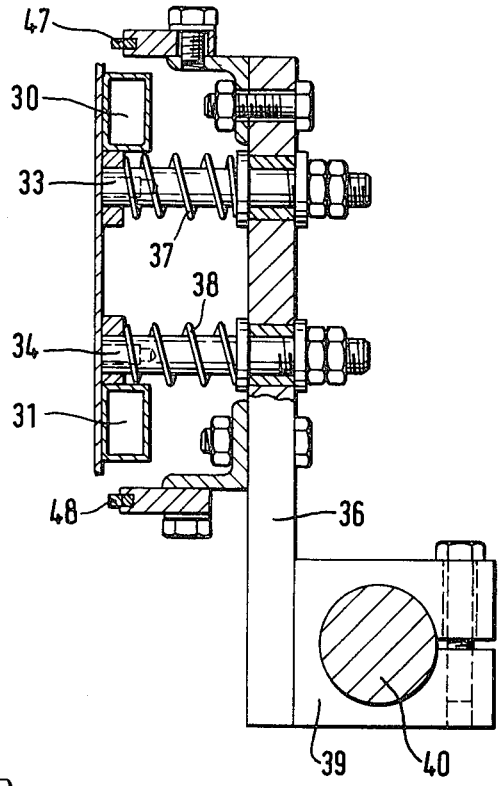
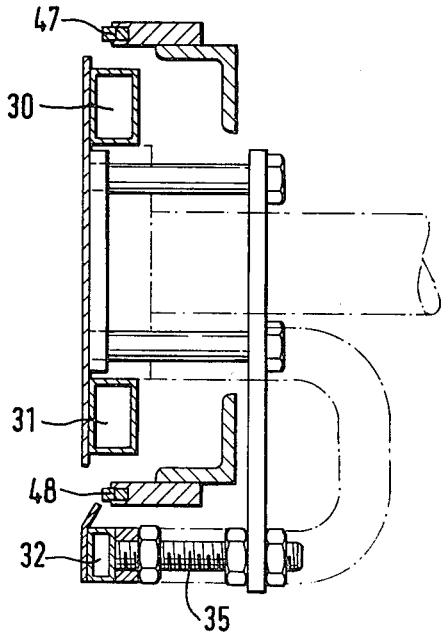
Fig. 5

APPARATUS FOR APPLYING WEB SECTIONS TO A FLAT-LYING WORKPIECE

The invention relates to an apparatus for applying a section severed from a web pulled off a supply reel onto a flat-lying workpiece, preferably an internal closure or a base cover sheet onto a pulled-open or already closed based, comprising a pair of intermittently driven rollers for feeding the web in sections and advancing it between clamping jaws which are arranged on both sides of the web, can be moved towards and away from each other and are respective divided by a coplanar gap extending transversely to the feeding direction of the web and guiding a knife for severing web sections, and at least one sucker which is fixed to swing levers and takes over the attracted severed section and swings it onto the flat-lying workpiece.

For example, in the manufacture of sacks from tube sections, the production of sealed bases makes it necessary to apply to the pulled-open bases internal closures which cover the inwardly lying edges of the corner folds, are connected around the corner folds and side folds by cementing or welding and are folded over together with the corner folds, or to apply base cover sheets to close the bases that have been shut by folding over the side folds. In the manufacture of sacks and bags it is also necessary for the performance of other manufacturing steps to apply to webs of material or to workpieces sections that have been severed from a web, for example for strengthening purposes.

In an apparatus of the aforementioned kind known from DE-AS No. 19 24 109 for making sacks from tube sections of thermoplastic material having a prismatic shape in the filled condition, base sheets to be applied to the pulled-open bases of the continuously fed tube sections are, after severing from the web, deposited onto a conveyor belt extending at right-angles to the feeding direction of this web parallel to the tube sections and substantially in the plane of their pulled-open bases and held thereon by a belt that travels together therewith but can be lifted off. Suckers that move therewith attract the base sheets by suction and, after raising the pressure belt, swing them onto the opened bases conveyed in a plane parallel to the conveyor belt feeding the base sheets. By reason of the conveyor and pressure belts for the base sheets continuously running together with the tube sections and because of the pivotable suckers, the known apparatus is not only expensive but it also fails to ensure that the base sheets do not slip while they are deposited on the conveyor running together therewith, while they are being transported and also while they are withdrawn by the suckers and deposited on the pulled-open bases; consequently proper positioning onto the pulled-open bases is not ensured.

It is therefore the problem of the present invention to provide an apparatus of the aforementioned kind employing simple means which permit sections severed from a web pulled off a supply reel to be properly located on flat-lying workpieces that are to be processed.

According to the invention, this problem is solved in that the sucker or suckers can be moved behind the clamping jaws in the feeding plane of the web to receive the projecting part of the web and, after severing the section, swung out of this position onto a plate which supports the workpiece and is arranged at an angle to said position. In the apparatus of the invention, the leading end of a web pulled off a supply reel is reliably located between the clamping jaws for severing sections until it is attracted by the sucker or suckers which, by swinging, securely apply the web section in the proper location to the flat-lying workpiece without the danger of slipping, the section being severed only after it has been attracted by suction.

If the web section and the flat-lying workpiece are of thermoplastic material, a development of the invention provides for welding bars to be secured to the swing levers at both sides of the suction bar to co-operate with the plate which supports the workpiece and serves as a counter jaw. The web section can then be connected to the flat-lying workpiece by two weld seams. Of course it is also possible to provide further welding jaws to weld the section to the flat-lying workpiece in the desired manner.

Desirably, the suction bars project beyond the welding bars and are depressible between same against spring force so that, after the welding jaws have been lifted off, the suction bars will still press against the workpiece until they can also be raised after the welding seams have cooled off.

In a further development of the invention, it is provided that the levers carrying the suction bars and the welding jaws are pivotably mounted on a lever pivotably mounted in the stand. If the levers are swung by their drives in a manner such that the lever carrying the suction bars and the welding jaws is turned out of its vertical position through 90° into a horizontal position, the suction bars and welding jaws can, without rotation, be lowered further onto the parallel workpiece disposed therebelow in that the lever pivotably mounted in the stand is swung in the direction of the pivotal motion previously executed by the lever mounted thereon and, to avoid rotation, the lever carrying the suction bars and the welding jaws is correspondingly turned back. However, in practice, the lever carrying the suction bars and welding jaws is turned back only so far that it can be swung by the lever mounted in the stand into a position parallel to the workpiece, in which it presses the section against same.

Further advantageous embodiments of the invention have been described in the subsidiary claims.

An example of the invention will now be described in more detail with reference to the drawing, wherein:

FIG. 4 is a section through the FIG. 3 apparatus along the line IV—IV and FIG. 5 is a section through the FIG. 3 apparatus along the line V—V.

Figure 1:
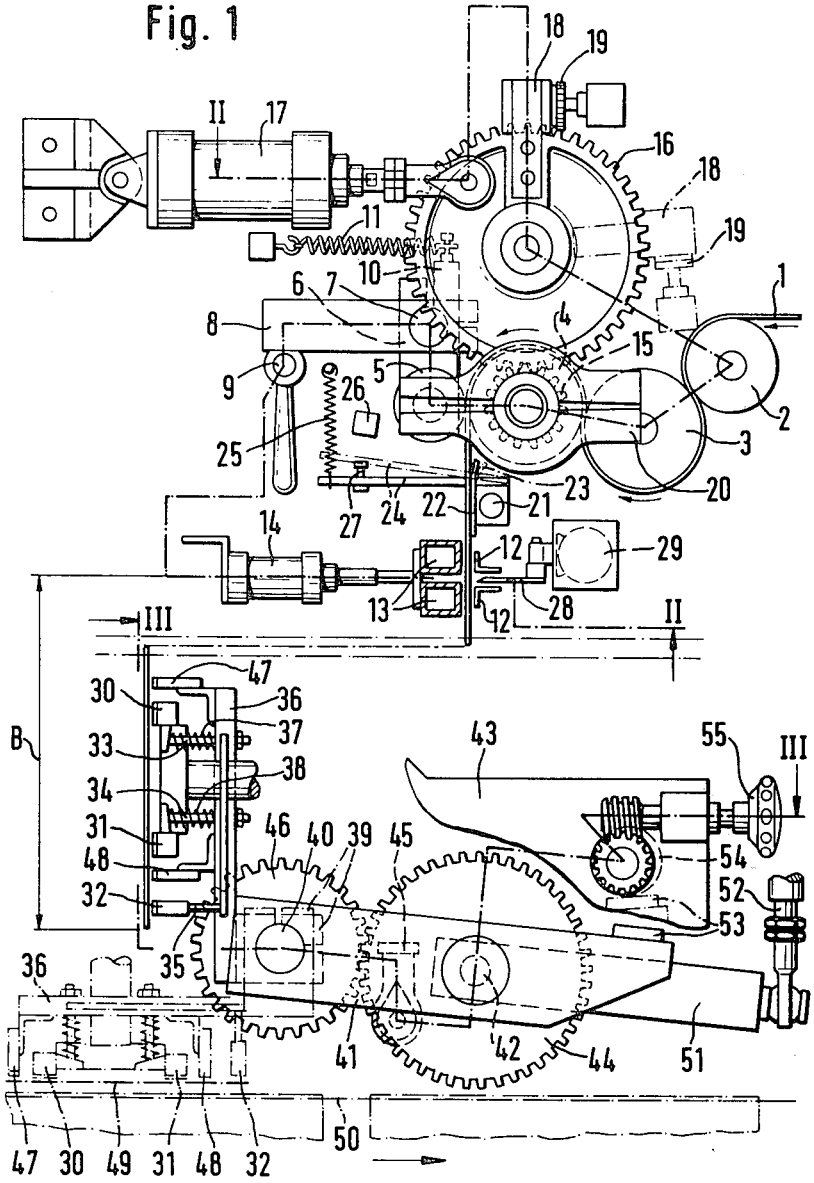
FIG. 1 is a section through the apparatus for applying web sections to a flat-lying workpiece in the direction of the intermittently conveyed workpiece.
Figure 2:
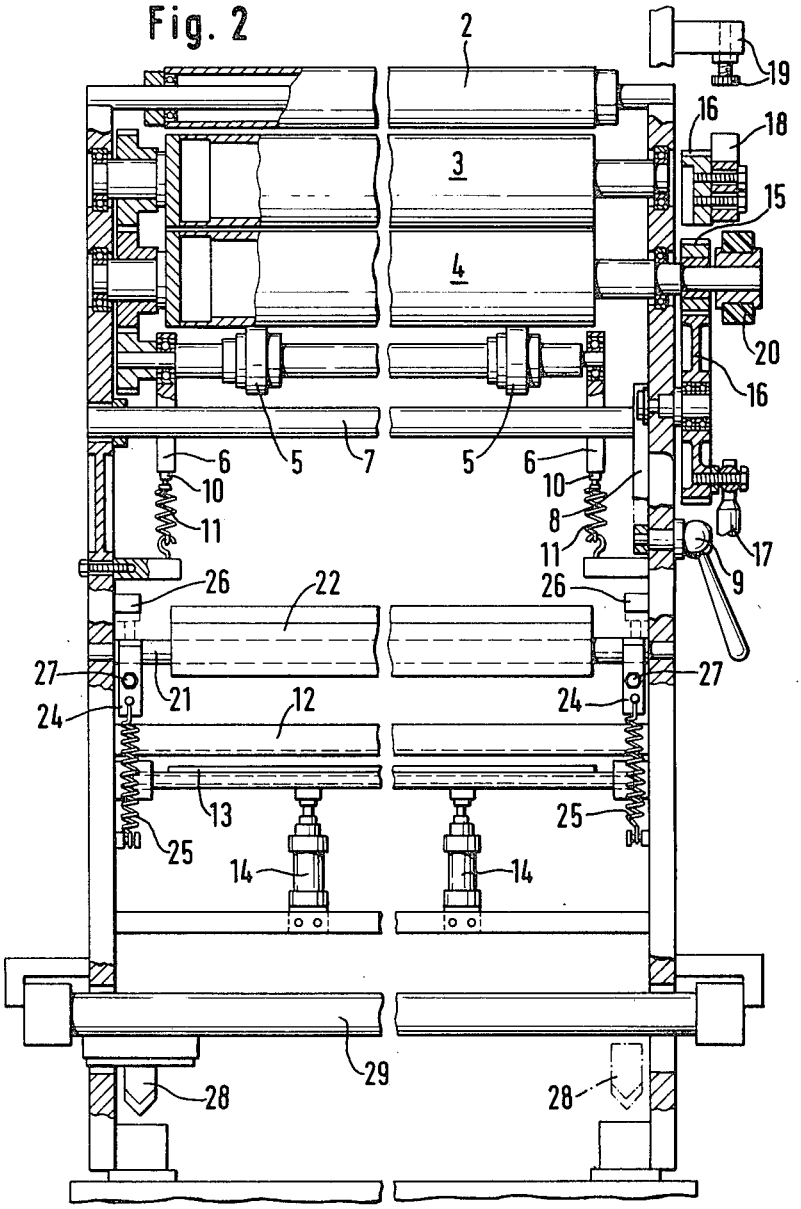
FIG. 2 is a section through the FIG. 1 apparatus along the line II—II.
Figure 3:
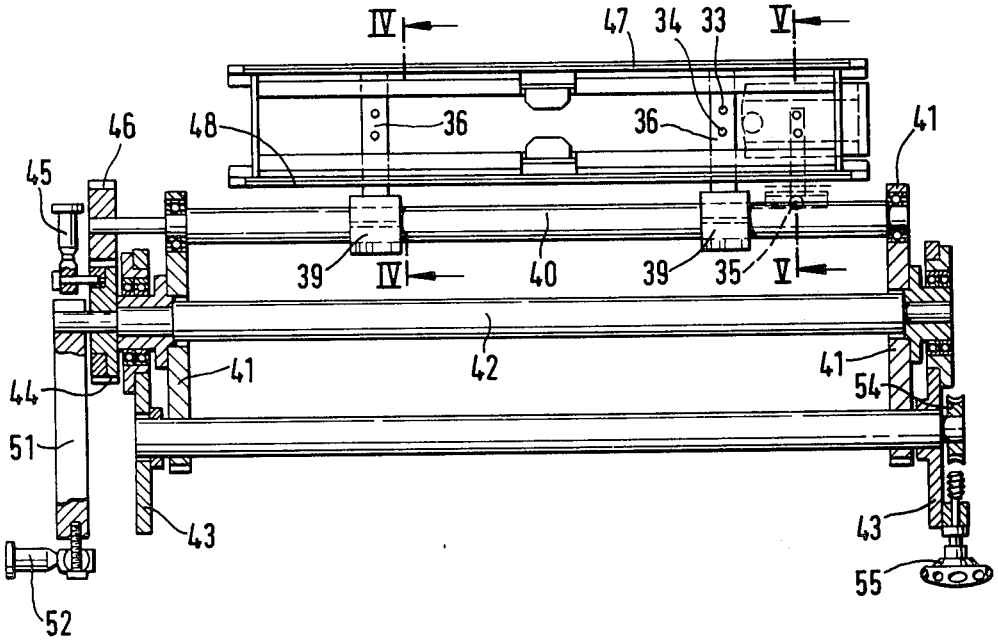
FIG. 3 is a section through the FIG. 1 apparatus along the line III—III.

1 designates the interconnected web of plastics internal closures that moves about a first direction-changing roller 2 and then about an S-feed formed by two rollers 3 and 4, both the rollers 3 and 4 being driven but not touching each other. In order that the feed for the web is in fact defined, the feed roller 5 presses onto the roller 4 of the S-feed, which presses against the roller 4 of the S-feed, so that there is frictional engagement between the two rollers 4 and 5 and the web is properly transported. For the purpose of introducing a web of internal closures, the feed roller 5 is secured to a lever 6 which is clamped to a shaft 7. A further lever 8 secured to this shaft 7 can be raised by way of an eccentric lever 9. By means of such raising, the roller 5 is swung clockwise away from the roller 4 of the S-feed so that a gap exists between the rollers 4 and 5. To ensure that the roller 5 always lies against the roller 4 during operation of the apparatus, the lever 6 is extended upwardly. This extension 10 is engaged by a tension spring 11 of which the strength may be adjustable.

Beneath the S-feed and the pressure roller there is a fixed counterbearing 12 and oppositely disposed movable clamping jaws 13; these can be pressed against the counterbearings 12 by two pneumatic piston-cylinder units 14 and clamp the web between each other.

However, before the clamping jaws 13 or 12 clamp the web between each other, the web is advanced by the feed to the extent B which corresponds to the width of the internal closure. For this purpose the feed roller 4 is provided with a gear 15 connected to the feed roller 4 by a free-wheeling device. The teeth of this gear 15 are in mesh with the teeth of a further gear 16 which can be turned through a given angle by a pneumatic piston-cylinder 17, the length by which the web is to be advanced being determined by the angle of rotation. This angle is adjustable. More particularly, a lever 18 on the gear 16 moves against an adjustable abutment 19. Since the piston-cylinder unit 17 is a pneumatic unit, adjustment of the abutment 19 can change the angle of rotation by as much as is permitted by the maximum stroke of the piston-cylinder unit 17. Now, during return motion of the piston cylinder 17, to prevent the rollers 3, 4, 5 from turning back by reason of the friction between the free-wheeling device and the gear 16, a block brake 20 is provided which holds the rollers 3, 4 and 5 tight. During this stage of feeding the internal closure web 1, the movable pressure jaws 13 are withdrawn from the fixed jaws so that the web can slide therebetween.

Now, to facilitate proper introduction of the web into this gap which cannot be too large for constructional reasons, a shaft 21 is disposed above the fixed jaws 12; a table plate 22 is placed on the shaft. This table plate 22 assumes the position 23 shown in broken lines during the introduction phase and thereby guides the arriving internal closure web into the gap formed by the jaws 13 and 12. The table plate 22 is here likewise resiliently mounted, namely in that the shaft 21 comprises a lever 24 which, by way of a spring 25, presses the lever 24 against a fixed abutment 26. The length of stroke is here again limited by an adjustable screw 27. If, now, a length of internal closure web determined by the angle of rotation of the gear 16 has passed between the jaws 12 and 13, the jaws 13 are moved by the two cylinders 14 against the fixed jaws 12 and clamp the internal closure web between each other.

As is particularly clear from FIG. 1, the fixed jaws 12 are arranged at a spacing from each other to leave a gap therebetween. This gap guides a knife 28 which is moved transversely to the internal closure web by a cylinder 29 and cuts through same.

Beneath the fixed jaws 12 there are three suction boxes 30, 31 and 32 which attract and hold the downwardly suspended internal closure web or rather the internal closure that has already been severed from the web. These suction boxes 30, 31 and 32 are secured to bolts 33, 34 and 35 which are passed through a rotatable frame member 36 and are resiliently pressed against the frame member 36 by springs 37 and 38. This frame member 36 is fixed to a clamping member 39 which is clamped to a rotatable shaft 40.

As already stated, the shaft 40 is rotatable and, more particularly, it is rotatably mounted in a lever 41. This lever 41 is fixed to the shaft 42, the shaft 42 being in turn rotatably mounted in the stand 43. A gear 41 is also rotatably mounted on the shaft 42. This gear 44 is intermittently moved to and fro by way of a pull rod 45 and, by reason of this to and fro motion, turns the gear 46 which is engaged with the gear 44 and fixed to the shaft 40. As shown in FIG. 4, the clamping members 39 and thus the suction boxes are fixed to the shaft 40 and, by reason of the movement of the pull rod, execute a pivotal motion in such a way that the position of the suction boxes 30, 31, 32 shown in full lines in FIG. 1 is changed so that they swing out of the vertical position shown in FIG. 1 into a horizontal position. This horizontal position is merely indicated by the two welding bars 47 and 48 which are shown in broken lines and are lightly fixed to the frame 36, and by the suction boxes 30, 31, 32 which hold one internal closure 49. In this position, the internal closure is still disposed above the table plane 50.

Now, in order that the internal closure can be placed on the pulled-open base disposed at the level 50 of the table plane, the entire frame 36 must be lowered towards the table plane, namely vertically without lateral displacement, i.e. this motion cannot be achieved solely by continuing to turn the gear 44 by means of the pull rod 45. For this reason a further lever 51 is clamped to the shaft 42 and this further lever is engaged by a further pull rod 52. By actuating this pull rod, the shaft 42 is turned and at the same time the lever 41 fixed thereto is turned so that a vertical movement of the frame 36 is achieved on the one hand by the additional pivoting of the lever 41 and on the other hand by actuation of the pull rod 45 and the consequent rotation of the shaft 40. By way of explanation, it may be added that the lever 41 swings counter-clockwise about the point 42 whereas the clamping member 39 is turned clockwise by actuating the pull rod 45 to achieve vertical motion. The pull rods 45 and 52 are controlled by appropriately shaped cam plates which are not shown in detail. During downward movement of the frame 36 which is horizontal at this stage, the suction boxes 30, 31 and 32 arrive on the table plane 50 during downward movement. During further downward movement, the suction boxes 30, 31 and 32 are depressed against the force of the springs 37 and 38 so that, during the further downward movement, the welding bars 47 and 48 are also lowered onto the table plane 50, whereafter the welding current is then switched on and the internal closure strip is welded to the pulled-open base of the sack (not shown) disposed in the table plane 50. Thereafter the frame 36 is again moved to the vertical position shown in full lines in FIG. 1, and the feed is again operated.

It is obvious that prior to swinging the frame 36 out of the vertical position into the horizontal position, the movable clamping jaws 13 are withdrawn from the fixed clamping jaws 12 by the two cylinders 14. It remains to be mentioned that the pull rod 52 is not positively connected to the associated cam plate but under friction so that the pivotal motion of the lever 41 can be set by way of the abutment 53 disposed on the lever 41, namely in that the abutment 53 moves against a rotatable eccentric 54 which can be adjusted by way of a spindle with knob 55.

We claim:

1. Apparatus for applying a section severed from a web pulled off a supply reel, e.g., of an internal closure or of a base cover-sheet, onto a flat-lying workpiece, such as a pulled-open or already closed base, comprising a pair of intermittently driven rollers for feeding and advancing a web in sections, clamping jaws arranged on both sides of the web, said jaws being movable toward and away from one another for clamping the web fed by the intermittently driven rollers and being divided into two pairs, the pairs being mounted with a space therebetween, a knife guided in the space between the pairs of jaws for severing web sections guided between said clamped by the jaws, and suction means including at least one sucker for gripping severed web sections, swing lever means for supporting said suction means in such manner that a gripped section is transferred onto the flat-lying workpiece, said at least one sucker being movable by said swing lever means between a first position downstream of the clamping jaws for receiving a part of a web that projects beyond the clamping jaws, and a second position rotated 90° from the first position, said at least one sucker being pressed against a workpiece in said second position.

2. An apparatus for applying a section severed from a web pulled off a supply reel onto a flat-lying workpiece, comprising a pair of driven rollers for feeding a web section in sections, means for intermittently driving said rollers, clamping jaws arranged on both sides of the web section fed by said rollers, said clamping jaws being disposed in spaced pairs that are movable towards and away from each other, to clamp the web, means for moving the clamping jaws towards and away from each other, a knife guided in the space between said pairs of clamping jaws for severing web sections, suction means having at least one sucker for gripping and holding a severed section, and swing lever means for moving the at least one sucker between a first position downstream of the clamping jaws in a feeding plane of the web to receive a part of the web projecting from the clamping jaws and a second position in which the at least one sucker presses the severed section onto a workpiece, said swing lever means rotating and translating said at least one sucker during movement thereof between said first and said second positions.

3. Apparatus according to claim 2, characterised in that welding bars are secured to the swing lever means at both sides of the at least one sucker, and in that a plate supports the workpiece and serves as a counter jaw.

4. Apparatus according to claim 2 or claim 3, characterised in that the at least one sucker projects beyond the welding bars and is constructed to be depressible between same against spring force.

5. Apparatus according to claim 2 or claim 3, characterised in that a guide plate is arranged to guide the leading end of the web between the opened clamping jaws, the guide plate being between the intermittently driven rollers and the clamping jaws.

6. Apparatus according to claim 5, characterised in that a shaft rotatable against spring force supports the guide plate so that it can be swung out of a position inclined to the conveying plane of the web into a web guiding position.

7. Apparatus according to claim 3, characterised in that the swing lever means includes first levers carrying the at least one sucker and the welding bars and a second lever hinged to a stand supporting the apparatus, the second lever pivotally mounting said first levers.

8. Apparatus according to claim 7, characterised in that pull rods are hinged to said first and said second levers for pivoting purposes.

9. Apparatus according to claim 8, characterised in that cam plates control the pull rods.

10. Apparatus according to claim 2, characterised in that a free-wheeling device is connected to one of the intermittently driven rollers, a first gear is connected to said free-wheeling device, a second gear is in meshing engagement with said first gear, a piston-cylinder unit is positioned between the second gear and a machine stand supporting the apparatus, the piston-cylinder unit being hinged to the second gear between a shaft and teeth of the gear.

11. Apparatus according to claim 10, characterised in that a brake is provided for holding the roller connected to the free-wheeling device during return motion of the gears.

12. Apparatus according to claim 10 or claim 11, characterised in that a lever is connected to the second gear, and an adjustable abutment fixed with respect to the stand cooperates with the lever for the purpose of adjusting a driving angle of the second gear.

13. Apparatus according to claim 10 or claim 11, characterised in that a lever pivotable against spring force mounts the other of the intermittently driven rollers.

14. Apparatus according to claim 10, characterised in that a further driven roller is positioned adjacent said one of said intermittently driven rollers, the web being slung about said one and said further driven rollers in an S-formation.

* * * * *